US008008564B2

(12) United States Patent
Wilens

(10) Patent No.: US 8,008,564 B2
(45) Date of Patent: Aug. 30, 2011

(54) HARMONY HAT

(76) Inventor: Sean Asher Wilens, Astoria, NY (US)

( * ) Notice: Subject to any disclaimer, the term of this patent is extended or adjusted under 35 U.S.C. 154(b) by 222 days.

(21) Appl. No.: 12/316,937

(22) Filed: Dec. 19, 2008

(65) Prior Publication Data

US 2009/0193565 A1 Aug. 6, 2009

Related U.S. Application Data

(60) Provisional application No. 61/006,916, filed on Feb. 1, 2008.

(51) Int. Cl.
*G10H 1/00* (2006.01)

(52) U.S. Cl. ..... 84/600; 84/609; 84/615; 84/649; 84/653

(58) Field of Classification Search ..... None
See application file for complete search history.

(56) References Cited

U.S. PATENT DOCUMENTS 4,525,878 A * 7/1985 Lowe, Jr. ..... 2/209.13
2004/0037051 A1* 2/2004 Hagiwara et al. ..... 361/749
2005/0187817 A1* 8/2005 Hall et al. ..... 705/14
2006/0176660 A1* 8/2006 Amiri ..... 361/683
2007/0287516 A1* 12/2007 Cheung et al. ..... 455/575.6
2008/0093459 A1* 4/2008 Lapstun et al. ..... 235/462.44
2008/0258921 A1* 10/2008 Woo et al. ..... 340/573.1
2009/0261171 A1* 10/2009 Lapstun et al. ..... 235/462.44
2010/0099943 A1* 4/2010 Davis ..... 600/28

* cited by examiner

*Primary Examiner* — Marlon Fletcher
(74) *Attorney, Agent, or Firm* — Howard Natter; Natter & Natter

(57) ABSTRACT

The Harmony Hat is a musical instrument which greatly improves the portability of an electronic musical instrument by: (1) integrating the keyboard surfaces into the visor of a hat; and (2) deploying a portable battery supply so as to eliminate any need for alternating current supplies or AC wall sockets. Additionally, the Harmony Hat integrates all the electronic components of an electronic organ or synthesizer into a portable and wearable hat so that a musician can use the hat to experiment with musical notes in any environment, such as while traveling in a car or plane, and even while jogging or walking. The Harmony Hat includes additional electronic controls to adjust the octaves of musical notes available on the keyboard.

5 Claims, 2 Drawing Sheets

FIG. 1
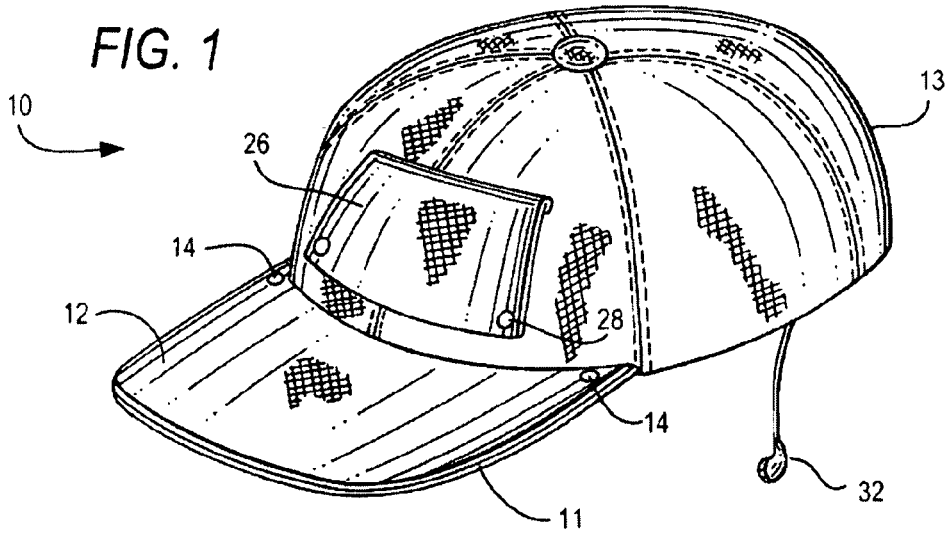
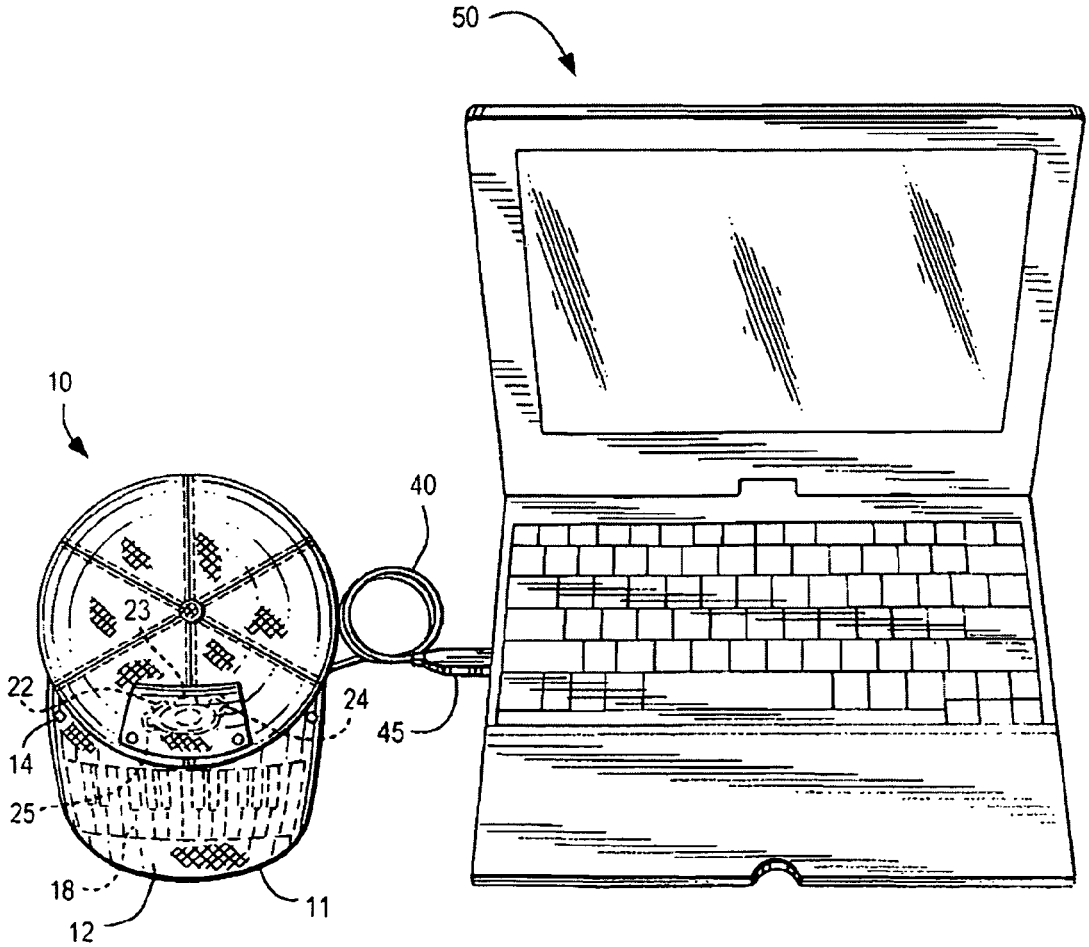
FIG. 3

HARMONY HAT

CROSS REFERENCE TO RELATED APPLICATIONS

This application is a continuation of U.S. Provisional patent application 61/006,916, filed Feb. 1, 2008. Priority to this application is claimed under 35 U.S.C. 119(e).

STATEMENT REGARDING FEDERALLY SPONSORED RESEARCH AND DEVELOPMENT

No Federally sponsored research was involved in the development of this invention.

BACKGROUND OF THE INVENTION

Musicians experiment with various arrangements of musical notes and chords in order to develop new musical arrangements, songs or various types of musical compositions. However, experimenting with musical sounds often requires immediate access to large instruments, such as a piano or electronic organ, which are not portable. The limited availability and access to piano or organ based instruments prevents musicians from experimenting with musical notes while on the go, such as while traveling in a car or airplane, or in any environment where the piano or organ are not otherwise available. While portable musical instruments such as guitars and electronic organs are generally known in the prior art, even these instruments are not sufficiently portable to permit musical experimentation while the musician is on the go, such as traveling in a car, bus or airplane. Another limitation on prior art musical instruments is the requirement for an alternating current power source supplied by a conventional AC outlet. Even for portable electronic instruments, such as electronic organs and electric guitars, this limitation seriously restricts the overall portability of these instruments.

BRIEF SUMMARY OF THE INVENTION

The aforementioned limitations in the prior art musical instruments are resolved by the improvements developed for the present invention. The Harmony Hat is a musical instrument which greatly improves the portability of an electronic musical instrument by: (1) integrating the keyboard surfaces into the visor of a hat; and (2) deploying a portable battery supply so as to eliminate any need for alternating current supplies or AC wall sockets. Additionally, the Harmony Hat integrates all the electronic components of an electronic organ or synthesizer into a portable and wearable hat so that a musician can use the hat to experiment with musical notes in any environment, such as while traveling in a car or plane, and even while jogging or walking.

BRIEF DESCRIPTION OF THE DRAWING

FIG. 1 is a general perspective view of the Harmony Hat, illustrating the various features of the preferred embodiment.

FIG. 3 is a perspective view of the Harmony Hat with a standard interface connection to a laptop computer.

DETAILED DESCRIPTION OF THE INVENTION

Figure 2:
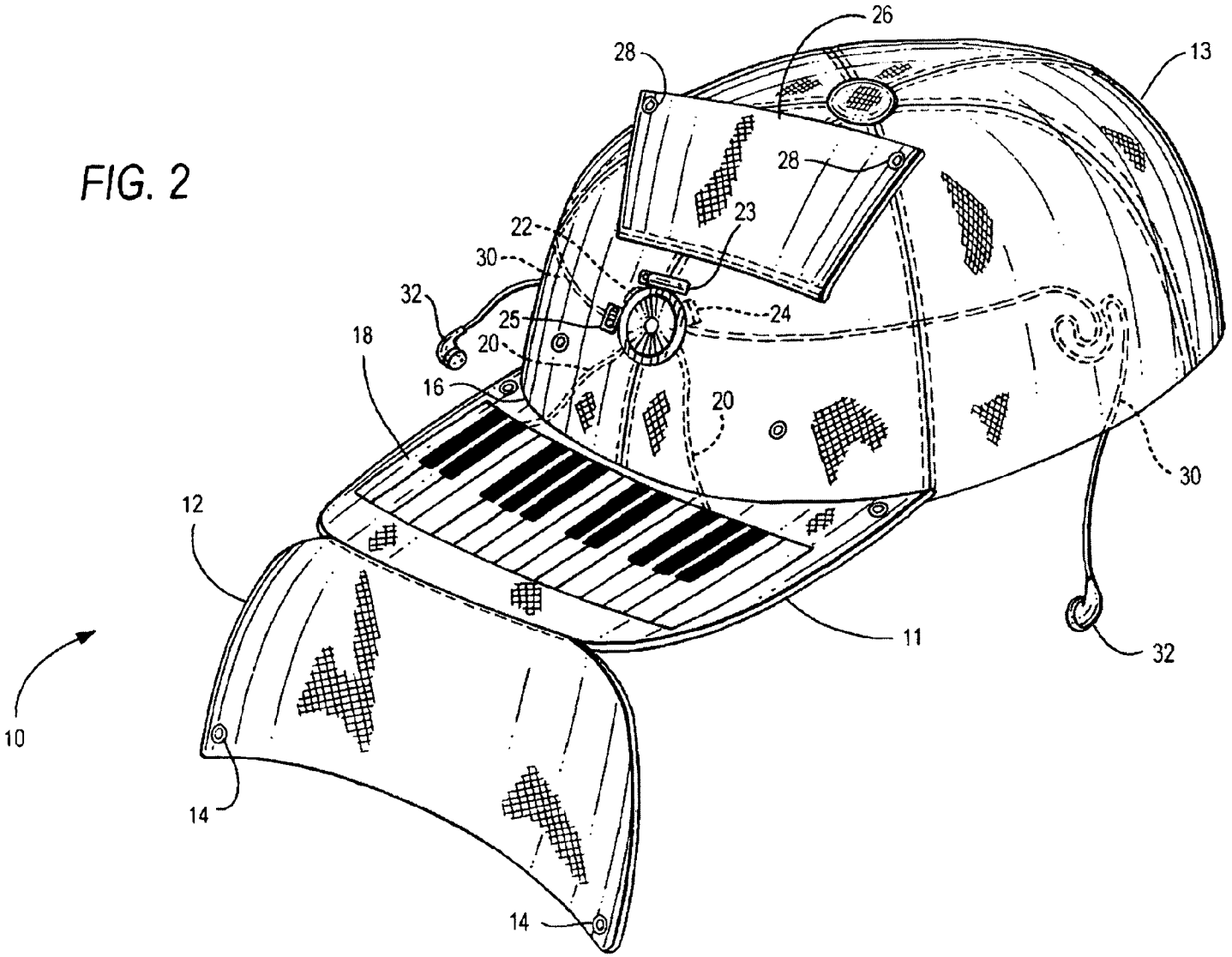
FIG. 2 is a detailed perspective view pointing to particular features associated with the preferred embodiment.

FIG. 1 is a general perspective view of the Harmony Hat 10, with limited reference citation numbers in order to clearly illustrate the basic configuration of the Harmony Hat. In its most basic configuration, the Harmony Hat is a cap having a visor in which a miniature keyboard is integrated into the visor. The electronics controlling the keyboard are integrated inside the cap portion of the visor. The exact location of the controlling electronics is not fixed, and can be placed at any interior or exterior position on the Harmony Hat.

FIG. 2 is a detailed perspective view of the preferred embodiments of the Harmony Hat 10. The basic hat structure includes a visor portion 11 and a cap portion 13. The visor portion 11 is attached to the cap portion 13 along a seam 16. The cap portion may be adjustable, such as with an adjustable slider or adjustable snaps. The cap is otherwise adjustable in any other manner known in the art. The visor portion 11 includes a covering flap 12 with button 14 so as to provide a pivotal cover over the visor portion 11. The covering flap 12 is designed to cover and protect electronic keyboard structure 18.

In the preferred embodiment of the invention, the electronic keyboard structure 18 is a silicone pad divided into individual touch sensitive areas corresponding to the individual keys that would normally be found on a conventional piano or electronic keyboard. Each touch sensitive area represents an individual piano key, and the overall silicone pad is divided into a plurality of such keys that are formed into the pad. The number of individual keys provided can vary, but in the preferred embodiment, a sufficient number of keys are provided so as to represent one or two octaves of a conventional piano keyboard. While the keys are represented as being formed on a flexible silicone substrate, other embodiments could be utilized, such as actual keyboard style keys or screen printed keys which are printed on an electrically conductive substrate.

Each of the individual keys in the silicone substrate are attached to sensors to detect touching of the individual key by a user. Each sensor is attached to a conductive wire 20 with each wire then attached to a central processing system 22 which controls the operation of the electronic keyboard structure 18. The central processing system 22 includes a microprocessor controller 24 which is controlled by an on/off switch 25. Turing the switch 25 to the "on" position activates the keyboard 18 of the Harmony Hat. The signals produced by depressing keys on the electronic keyboard structure 18 are transmitted by the wires 20 to the microprocessor controller 24. The controller 24 in turn processes the signals into musical notes.

The central processing system 22 additionally includes a power supply 23 in the form of standard batteries. The batteries may be of any size of configuration, provided that they are small enough to fit on the cap portion 13. The power supply provides power for entire system, including the electronic keyboard structure 18, the microprocessor controller 22 and any external outputs, which will be discussed in further detail below.

The central processing system 22, including the microprocessor controller 24, on/off switch 25 and power supply 23 are covered by the flap 26. The flap 26 in turn is secured to the cap 13 with buttons or snaps 28. The flap 26 serves to cover and protect the non-keyboard electronic components of the system.

The signals produced by depressing keys on the electronic keyboard structure 18 are transmitted by the wires 20 to the microprocessor controller 24. The controller 24 in turn processes the signals into musical notes. The electronic signals representative of musical notes are transmitted via conductive wires 30 to external headphones 32. Alternatively, the signals representing musical notes may be transmitted to an external speaker located adjacent to, or as part of, the central processing system 22.

FIG. 3 illustrates the capability of the Harmony Hat to interface with a standard laptop or desktop computer, with FIG. 3 showing the interface to a laptop computer 50 in particular. Such interface can be accomplished via a standard USB (universal serial bus) connection plug 45 and cable 40 that connects to the computer. The connection of the cable 40 to the Harmony Hat can be achieved by a standard USB connector, or any other standard data connection pin, such as, for example, ½" and ¼" inch connection pins. The Harmony Hat can be configured to include the appropriate matching USB plug or matching pin connection plug at any point on the Harmony Hat, provided that such plug is connected to the central processing system 22 to receive data and the power supply 23 to receive power. By such connection, the Harmony Hat would become an interface for audio or musical programs that are otherwise run on the computer 50. The audio or musical programs could also be configured to save any musical notes/chords played on the Harmony Hat's keyboard structure 18.

Additional optional features can be provided beyond those which are described herein. For example, the microprocessor controller 24 can further include an adjustment switch which can change the musical octaves which are playable by the keyboard 18. For example, such a switch could control the keyboard 18 so that it is capable of switching between lower octaves, middle octaves and higher octaves, thus allowing a far greater range of musical notes to be played on the limited keyboard which is provided on the visor.

Any other variations or embodiments on either the cap, the keyboard, the electronics or the output systems which are within the level of skill in the art are considered to be within the scope of the present disclosure.

What is claimed is:

1. A musical apparatus in combination with a hat comprising:

a) a user wearable hat including a cap portion and a visor portion;

b) a flexible touch sensitive keyboard integrated into said visor portion;

c) processor means for processing input signals produced by activation of said touch sensitive keyboard;

d) output means for outputting and audibly reproducing the signals processed by the processor means as musical notes;

e) octave control means for controlling the octaves of the musical notes; and f) power supply means for energizing said keyboard, processor means, output means and octave control means, further including a USB connection means for providing a data connection between the musical apparatus and a computer.

2. A musical instrument as claimed in claim 1 wherein the keyboard is divided into distinct touch sensitive areas corresponding to the keys of a piano keyboard.

3. A musical instrument as claimed in claim 1 wherein the visor portion is provided with a flap for selectively covering the keyboard.

4. A musical instrument as claimed in claim 1 wherein the cap portion includes a flap for selectively covering at least one of the processor means, the output means, the octave control means and the power supply means.

5. A musical instrument combined with an article of headwear comprising a hat including a cap portion and a visor portion, said visor portion incorporating an electronic musical keyboard having a plurality of touch sensitive keys, said keyboard being operatively linked to a central processing system mounted within the cap for producing electronic signals corresponding to the respective touch sensitive keys, including a microprocessor controller for receiving and processing the signals as musical notes and connector means for selectively interfacing the musical instrument to a computer for receiving the processed signals and generating audible musical sounds wherein the microprocessor controller is adapted to change the musical octaves to allow for a greater range of musical notes.

* * * * *